US007014043B2

(12) United States Patent
Raghunathan et al.

(10) Patent No.: US 7,014,043 B2
(45) Date of Patent: Mar. 21, 2006

(54) MULTI-LEVEL STACKING CONTAINER

(75) Inventors: Narayan Raghunathan, Mississauga (CA); Don M. U. Ogden, Palgrave (CA)

(73) Assignee: Norseman Plastics, Limited, Ontario (CA)

( * ) Notice: Subject to any disclaimer, the term of this patent is extended or adjusted under 35 U.S.C. 154(b) by 0 days.

(21) Appl. No.: 10/045,035

(22) Filed: Jan. 15, 2002

(65) Prior Publication Data

US 2002/0179480 A1 Dec. 5, 2002

Related U.S. Application Data

(60) Provisional application No. 60/261,201, filed on Jan. 16, 2001.

(30) Foreign Application Priority Data

Jan. 15, 2001 (CA) ..... 2331202

(51) Int. Cl.
*C08F 2/58* (2006.01)

(52) U.S. Cl. ..... 206/506

(58) Field of Classification Search ..... 206/503, 206/505, 506

See application file for complete search history.

(56) References Cited

U.S. PATENT DOCUMENTS

| | | | |
|---|---|---|---|
| 2,026,204 | A | 12/1935 | Andrews |
| 2,029,746 | A | 2/1936 | Tufts et al. |
| 2,061,414 | A | 11/1936 | Tufts et al. |
| 2,641,383 | A | 6/1953 | Coursey |
| 3,375,953 | A | 4/1968 | Miller, Jr. |
| 3,379,339 | A | 4/1968 | Asenbauer |
| 3,421,656 | A | 1/1969 | Asenbauer |
| 3,659,743 | A | 5/1972 | Box |
| 3,752,352 | A | 8/1973 | Senecal |
| 3,780,905 | A | 12/1973 | Herolzer |
| 3,951,265 | A | 4/1976 | Carroll |
| 4,000,817 | A | 1/1977 | Sanders et al. |
| 4,105,117 | A | 8/1978 | Atkin et al. |
| 4,106,623 | A | 8/1978 | Carroll et al. |
| 4,109,791 | A | 8/1978 | Clipson et al. |
| 4,391,369 | A | 7/1983 | Stahl et al. |
| 4,573,577 | A | 3/1986 | Miller |

(Continued)

FOREIGN PATENT DOCUMENTS

| | | |
|---|---|---|
| EP | 0 370 771 A2 | 5/1990 |

(Continued)

*Primary Examiner*—Stephen Castellano
(74) *Attorney, Agent, or Firm*—Katten Muchin Rosenman, LLP

(57) ABSTRACT

A multi-level stacking container is disclosed. The container comprises: a base; a pair of opposed sidewalls extending from the base; and a pair of moveable support bars operatively coupled to and extending across the pair of opposed sidewalls, the pair of support bars being moveable between at least three positions such that the container is stackable in at least three positions with a second like container. In one aspect, the container comprises a base, a first pair of opposing sidewalls extending from the base, each of the sidewalls including a rim, an inner surface, an outer surface, the rim including first and second longitudinally-spaced apart pluralities of recesses formed therein, and first and second moveable support bars configured to extend across the pair of opposing sidewalls, each of the moveable support bars including an elongated rod configured to be received within any of the recesses of either of the first or second pluralities of recesses formed in the respective rims of each of the first pair of sidewalls, the rod including first and second inwardly-turned ends pivotally coupled to the respective outer surfaces of each of the sidewalls.

12 Claims, 7 Drawing Sheets

U.S. PATENT DOCUMENTS

| | | | | |
|---|---|---|---|---|
| 5,287,966 | A | | 2/1994 | Stahl |
| 5,344,022 | A | | 9/1994 | Stahl |
| 5,609,254 | A | * | 3/1997 | Loftus et al. ..... 206/506 |
| 5,881,902 | A | | 3/1999 | Ackermann |

FOREIGN PATENT DOCUMENTS

| | | |
|---|---|---|
| FR | 1131652 | 2/1957 |
| GB | 2 067 167 | 7/1981 |

* cited by examiner

MULTI-LEVEL STACKING CONTAINER

FIELD OF THE INVENTION

This invention relates to stackable containers and, more particularly, to a multi-level stacking container that can be stacked in at least three positions.

BACKGROUND OF THE INVENTION

Stacking and nesting containers are commonly used for transportation and storage of food goods such as produce, baked goods. Such containers generally have a rectangular base with upstanding sidewalls extending from the base. Some stacking and nesting containers include support bars that are pivotably mounted at each end and extend across two opposed sidewalls. These support bars can be pivoted between a stacking support position and a nesting position.

When goods are placed in the container, the support bars are placed in the stacking support position. A second container can then be placed on the first container and is supported by the support bars, thereby protecting the contained goods from being crushed by the second container.

When the container is empty, the support bars are placed in the nesting position and a second container can be nested such that it is received in the first container, thereby reducing the stacking space required.

These container suffer from the disadvantage of having only two stacking positions. A second container can be stacked on a first container in a stacking position to protect goods container in the first container, or in a nested position when the first container is empty. These containers do not have any intermediate stacking position to save stacking space when smaller or fewer items are placed in the container.

Accordingly, it is an object of the present invention to provide a multi-level stacking container that can be stacked in more than two positions depending on the goods contained to safe stacking space in transportation or storage.

SUMMARY OF THE INVENTION

A multi-level stacking container is provided. The container has a base and a pair of opposed sidewalls extending from the base. A pair of support bars are operatively coupled to and extend across the pair of opposed sidewalls. The support bars are moveable between at least three positions such that the container is stackable in at least three positions with a second like container.

In one aspect, the present invention provides a multi-level stacking container comprising a base, a first pair of opposing sidewalls extending from the base, each of the sidewalls including a rim, an inner surface, an outer surface, the rim including first and second longitudinally-spaced apart pluralities of recesses formed therein, and first and second moveable support bars configured to extend across the pair of opposing sidewalls, each of the moveable support bars including an elongated rod configured to be received within any of the recesses of either of the first or second pluralities of recesses formed in the respective rims of each of the first pair of sidewalls, the rod including first and second inwardly-turned ends pivotally coupled to the respective outer surfaces of each of the sidewalls.

DESCRIPTION OF PREFERRED EMBODIMENTS

Figure 1:
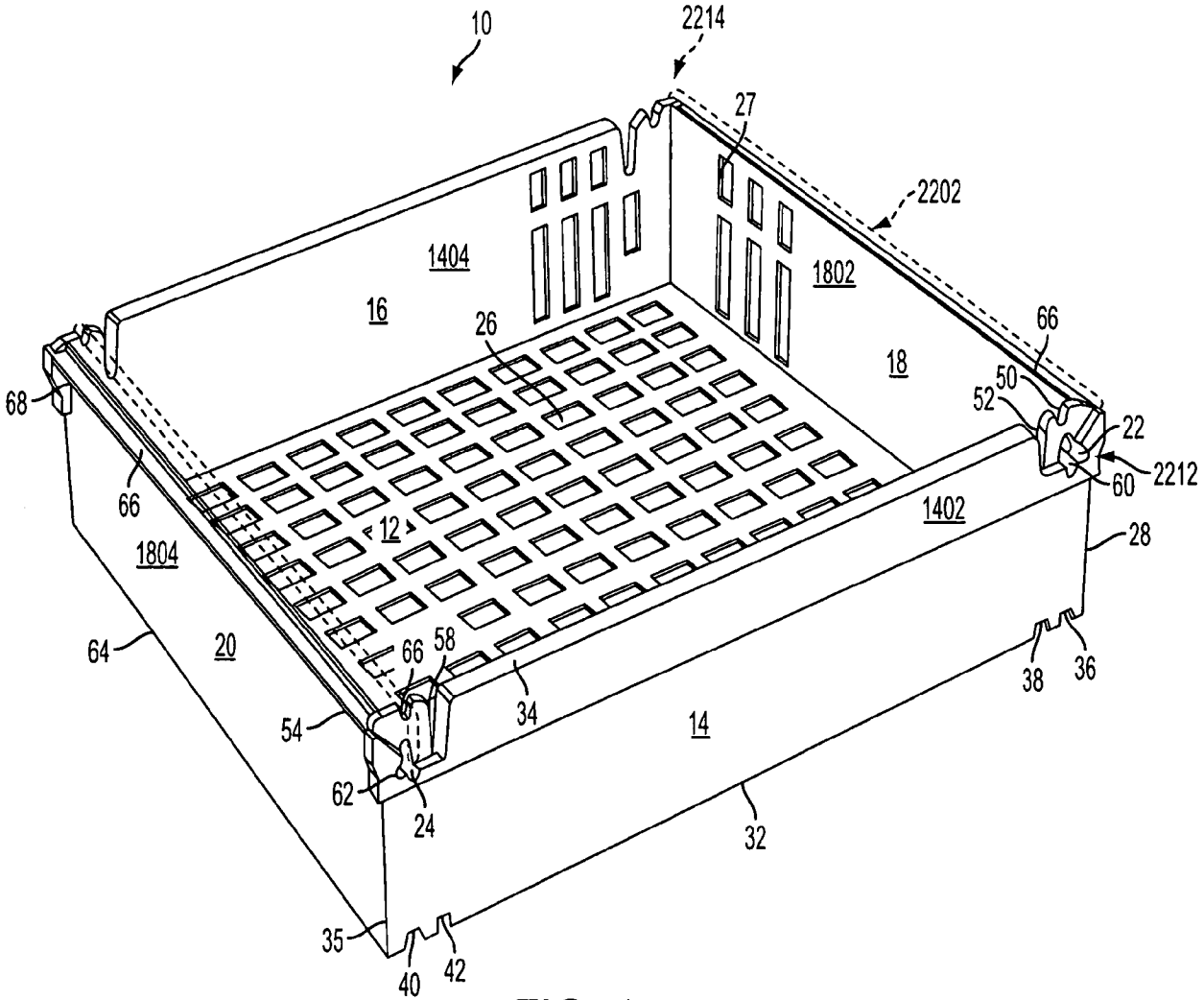
FIG. 1 is an isometric view of a multi-level stacking container according to the invention.

Reference is first made to FIG. 1 to describe a preferred embodiment of a multi-level stacking container indicated generally by the numeral 10. The container 10 has as base 12 and two pairs of opposed sidewalls 14, 16, 18, 20 projecting therefrom. A pair of support bars 22, 24 are operatively coupled to and extend across a pair of the opposed sidewalls 14, 16. These support bars 22, 24 are moveable between at least three positions such that the container is stackable in at least three positions with a second like container.

The multi-level stacking container 10 will now be described in more detail. As seen in FIG. 1, the base 12 is substantially rectangular and has a plurality of apertures 26 to reduce the container weight and allow ambient circulation. Each of the sidewalls 14, 16, 18, 20 are integral with and project from the sides of the base 12 at an obtuse angle. This permits nesting of the container 10 with a similar, second container. In this embodiment, a first pair of the opposed sidewalls 14, 16 are longer than a second pair of the opposed sidewalls 18, 20. Similar to the base, each of the sidewalls 14, 16, 18 20 have a plurality of apertures 27.

The base 12 and the sidewalls 14, 16, 18, 20 are injection-molded high-density polyethylene and the support bars 22, 24 are metal, such as stainless steel.

Referring now to one of the first pair of opposed sidewalls 14, 16, the sidewall 14 is substantially rectangular, with first and second ends 28, 30, respectively, and a pair of edges, a basal edge 32, proximal the base 12, and a rim 34 opposite the basal edge 32.

As shown in FIG. 1, the basal edge 32 has a first outer recess 36, proximal the end 28, and a first inner recess 38, laterally spaced therefrom. Similarly, there is a second outer recess 40 proximal to the end 30 and a second inner recess 42 on the basal edge 32. These recesses 36, 38, 40, 42 are for receiving the support bars 22, 24 of a second similar container when stacked thereon. This will be described further below.

Figure 2:
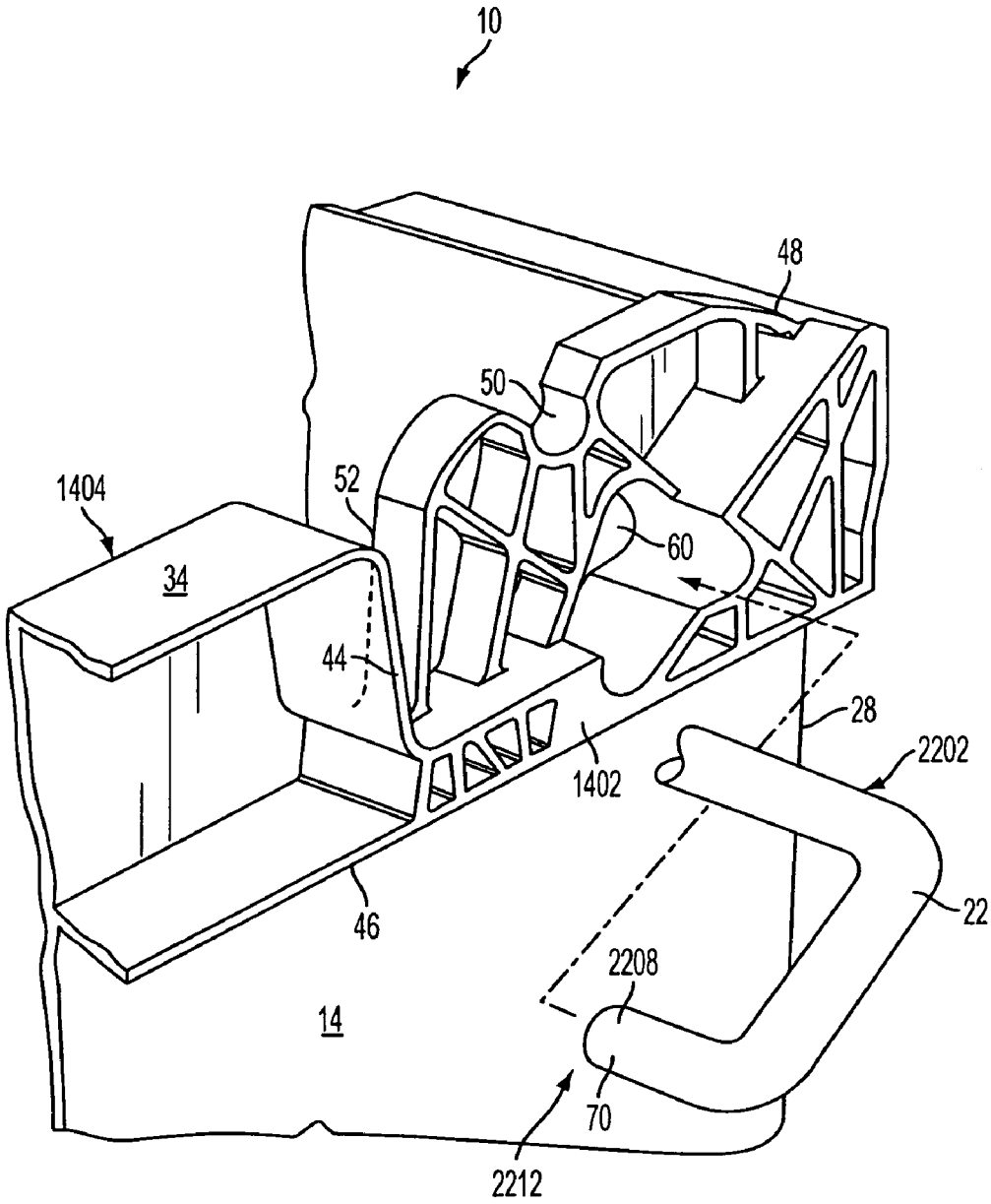
FIG. 2 is an exploded partial isometric view of the multi-level stacking container of FIG. 1 showing a support bar removed from a floating pivot in a sidewall.

Referring now to FIGS. 1 and 2, sidewall 14 includes an outer surface 1402 and an inner surface 1404. Sidewall 14 comprises a plurality of reinforcing ribs 44 extending between the rim 34 and a lip 46. Clearly, the lip 46 extends peripherally from the outer surface 1402 of the sidewall 14 substantially parallel to the rim 34 along the length of the sidewall 14. This lip 34 rests or is supported on the rim 34 of a second, similar container when the container 10 is nested therein.

Proximal the end 28, a first plurality of recesses is formed in the rim 34. In one embodiment, the first plurality of recesses consists of outer and inner recesses 50, 52. Each of the recesses 50, 52 extends from the inner surface 1404 to the outer surface 1402, thereby extending through the width of the sidewall 14. Recesses 50, 52 are spaced apart from each other, such that one recess 52 is remote from the end 28 relative to the recess 50. In this respect, recesses 50, 52 are longitudinally spaced apart from each other along the rim 34. The recess 52 extends deeper into the sidewall relative to the recess 50.

Similarly, proximal the end 30, a second plurality of recesses is formed in the rim 34. In one embodiment, the second plurality of recesses consists of outer and inner recesses 56, 58. Each of the recesses 56, 58 extend from the inner surface 1404 to the outer surface 1402, thereby also extending through the width of the sidewall 14. Recesses 56, 58 are spaced apart from each other such that the recess 58 is remote from the end 30 relative to the recess 56. In this respect, recesses 56, 58 are longitudinally spaced apart from each other along the rim 34. The recess 58 extends deeper into the sidewall relative to the recess 56.

A first floating pivot 60, defined by a slot formed on the outer surface 1402 of the sidewall 14, is located between the rim 34 and the lip 46, proximal the first outer and inner recesses 50, 52. The first floating pivot 60 is configured to receive a lug 2208 of one of the support bars 22, while a similar second floating pivot 62 on the same sidewall 14 is configured to receive a lug 2208 of the other of the support bars 24. Floating pivots 60, 62 are longitudinally spaced apart from each other.

While the above description is directed to the sidewall 14, it will be understood that the sidewall 16 has a similar structure and therefore will not be further described herein.

Referring now to the second pair of opposing sidewalls 18, 20, each of sidewalls 18, 20 extend between sidewalls 14, 16. Sidewall 18 joins the respective first ends 28 of sidewalls 14, 16. Similarly, sidewall 20 joins the respective second ends 30 of the sidewalls 14, 16.

Referring now to one of the second pair of opposing sidewalls 18, 20, sidewall 18 is substantially rectangular and includes a basal edge 64, proximal the base 12, and an opposite rim 66. Sidewall 18 includes an inner surface 1802 and an outer surface 1804. Ledge 48 extends peripherally from outer surface 1804, and is disposed between the rim 66 and the basal edge 64. Ledge 48 presents a surface for supporting the bar 22 in the position illustrated in FIGS. 4 and 7. In this respect, ledge 48 includes a groove configured to receive the support bar 22.

While the above description is directed to the sidewall 18, it will be understood that the sidewall 20 has a similar structure and therefore will not be further described herein.

Referring to FIG. 2, a partial isometric view of the support bar 22 removed from the first floating pivot 60 is shown. The support bar 22 is substantially C-shaped with inwardly turned ends 2212, 2214. The support bar 22 is suitably sized such that one of the ends 2212, 2214 is received in the first floating pivot 60 on the sidewall 14, while the other of the ends 2212, 2214 is received in the respective first floating pivot 60 on the sidewall 16.

In this respect, support bar 22 includes an elongated rod 2202. The elongated rod 2202 is configured to be received in any one of the recesses of the respective first or second plurality of recesses formed in each of the respective sidewalls 14, 16. The elongated rod 2202 extends outwardly beyond respective planes defined by each of the sidewalls 14, 16. The elongated rod 2202 includes first and second ends 2212, 2214 carrying inwardly turned lugs 2208, 2210. The lugs 2208, 2210 are received and supported within a respective floating pivot 60 of each of the sidewalls 14, 16. Further, the lugs 2208, 2210 are configured for movement within the respective floating pivots 60 as the support bar 22 is moved between positions of registration within recesses 50, recess 52, and on ledge 48, as will be illustrated hereafter.

Figure 3:
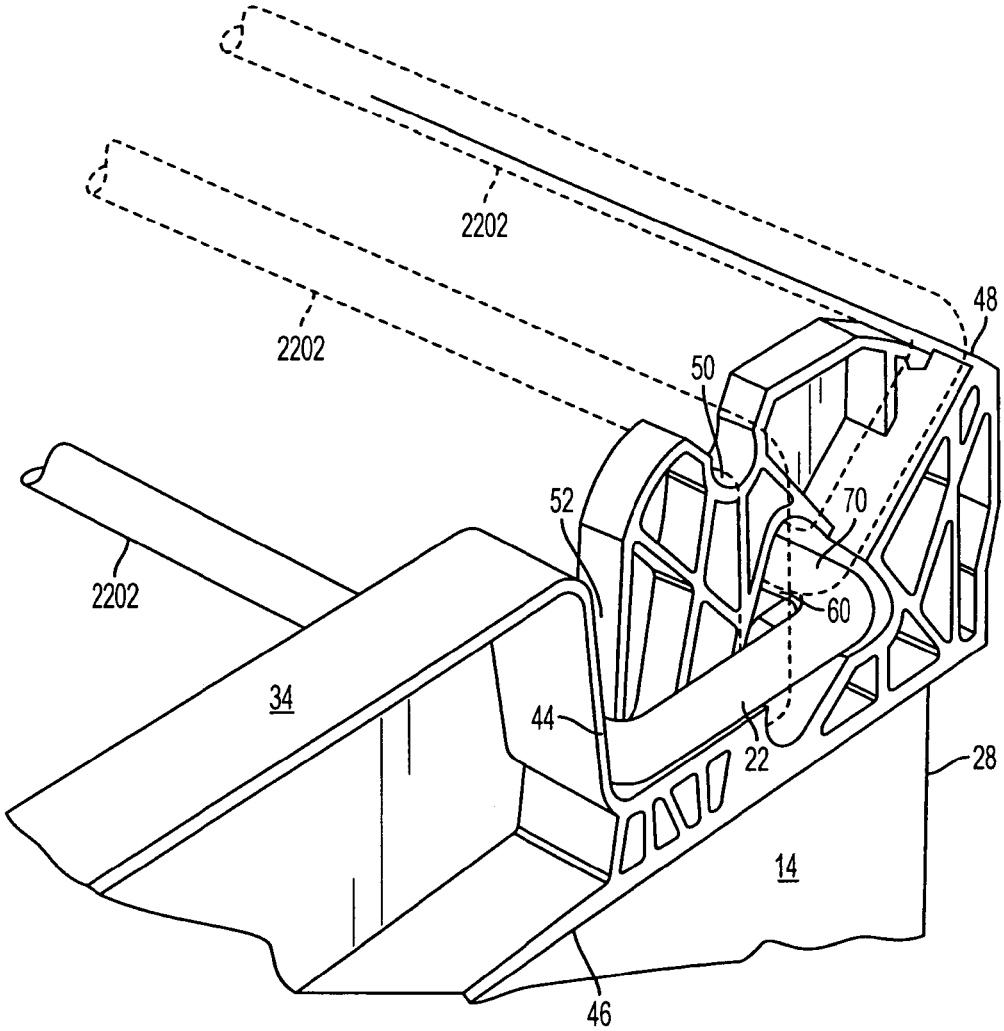
FIG. 3 is a partial isometric view of the multi-level stacking container of FIG. 1 showing the support bar in a second stacking position in full outline, a first stacking position in ghost outline and a nesting position, also in ghost outline.

Referring now to FIG. 3, the support bar 22 is shown in three different positions. Clearly the support bar 22 can be located to rest on the first ledge 48 shown in ghost outline, herein referred to as a nesting position. In this position, the support bar 22 rests along the rim 66 of the sidewall 18. The support bar 22 can also be located in the first outer recess 50, herein referred to as a first stacking position and shown in ghost outline, or in the first inner recess 52, herein referred to as a second stacking position and shown in full outline. It will be understood that the support bar 22 rests on the corresponding ledge 48, first outer recess 50, and first inner recess 52 of the sidewall 16 when in the nesting, first stacking and second stacking positions, respectively.

The first floating pivot 60 on each of the sidewalls 14, 16 is larger than each of the ends 70 of the support bar 22. Thus, the ends 70 of the support bar 22 can both slidingly and rotatably move within each first floating pivot 60 as the support bar 22 is moved between the three positions. While the above description is directed to the support bar 22, it will be understood that the support bar 24 has a similar structure and operation.

The use of the multi-level stacking container 10 will now be described with reference to a second similar container. To simplify the description, the numerals used previously in describing the container 10 will be used with reference to the second, similar container after raising the numerals by 100.

Figure 4:
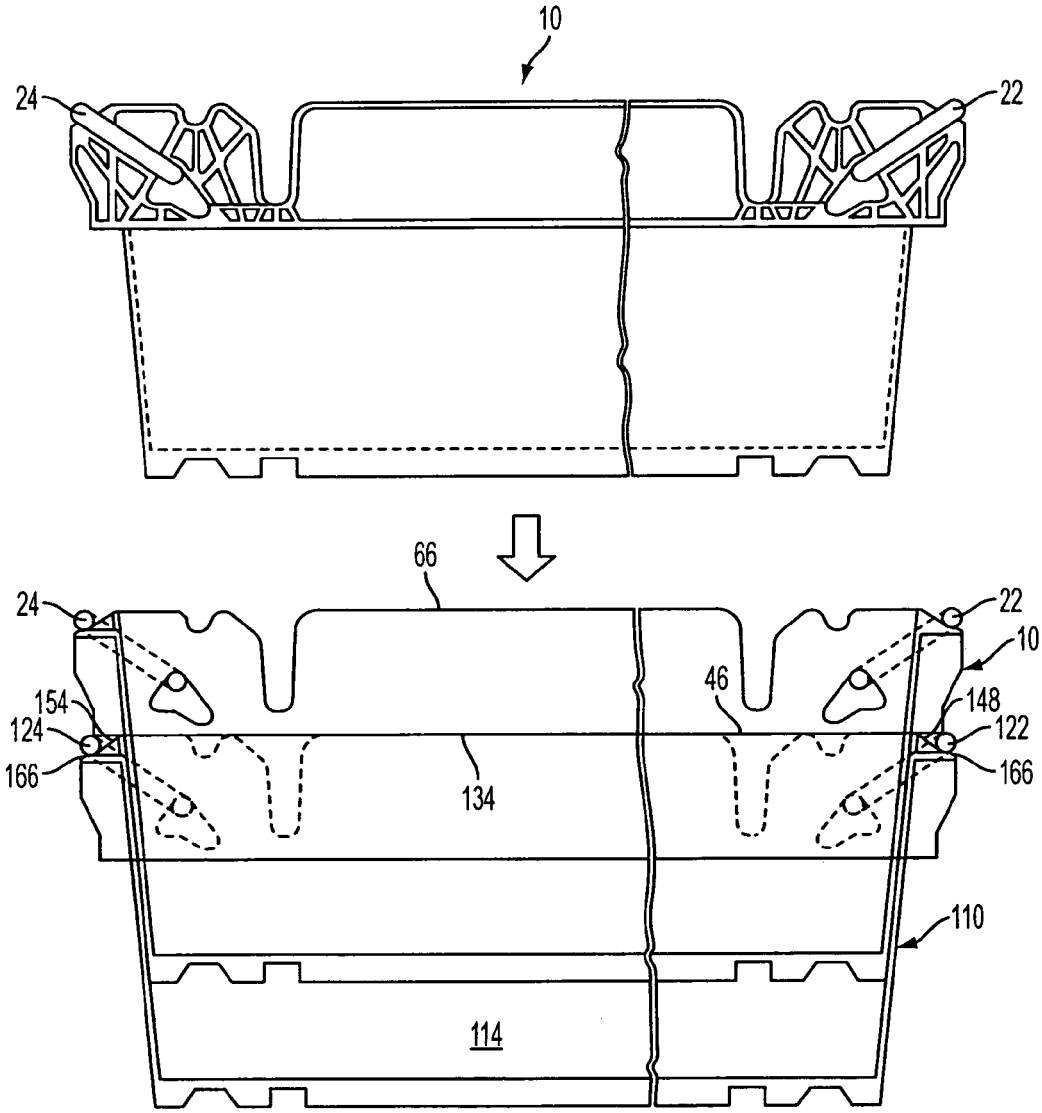
FIG. 4 is a partial side view of the container of FIG. 1 showing the support bar in the nesting position and a partial sectional side view of the container of FIG. 1 in a nested position with a like container.

Referring to FIG. 4, the container 10 is shown in the nested position with the second container 110. To arrange the containers, 10, 110 in this position, the support bars 122, 124 are moved to the nesting position on the first ledge 148, 154, respectively, along the rim 166 of the respective sidewalls 118, 120. Then the container 10 is placed in the second container 110 such that the lip 46 of the container 10, abuts the rim 134 of the second container 110. In this respect, the container 10 clears the support bars 122, 124 of the container 110.

Figure 7:
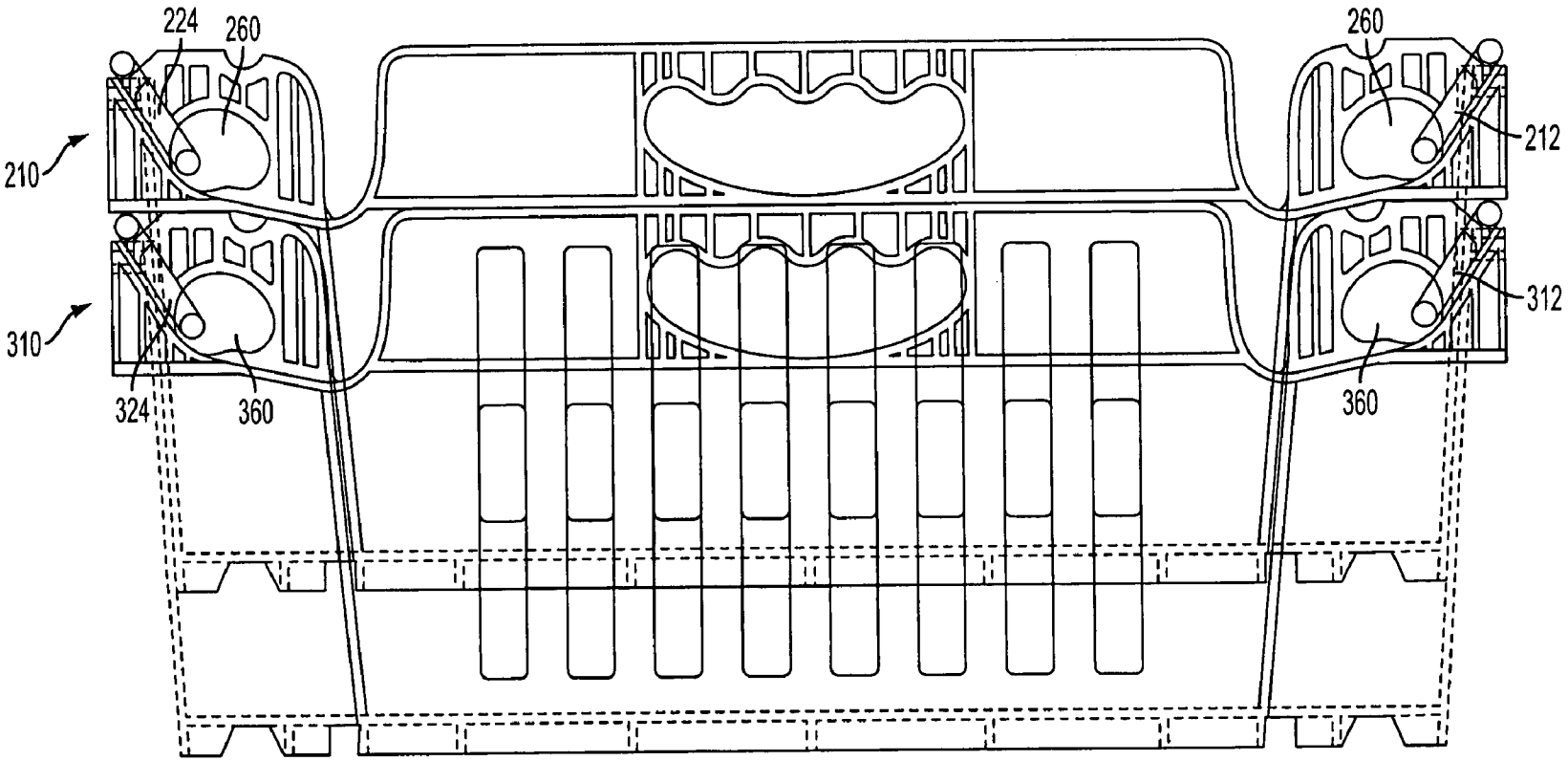
FIG. 7 is a partial side view of another embodiment of the container in a nested position with a like container.

FIG. 7 illustrates another embodiment of the present invention, container 210, in the nested position with a second like container 310. The containers 210, 310 are similar to containers 10, 110 in many respects, with the exception of vertical location of the support bars 212, 224 and 322, 324 and their relationship with like containers when stacked in the nested position, as well as the shape of their respective first floating pivots 260, 360. In this embodiment, containers 210, 310 are configured such that, when in the nested position, container 310 does not clear support bars 222, 224, but rather is supported on support bars 222, 224.

Further, the first floating pivots 260, 360 are peanut-shaped. In another embodiment (not shown), the floating pivots 260, 360 are circular.

Figure 5:
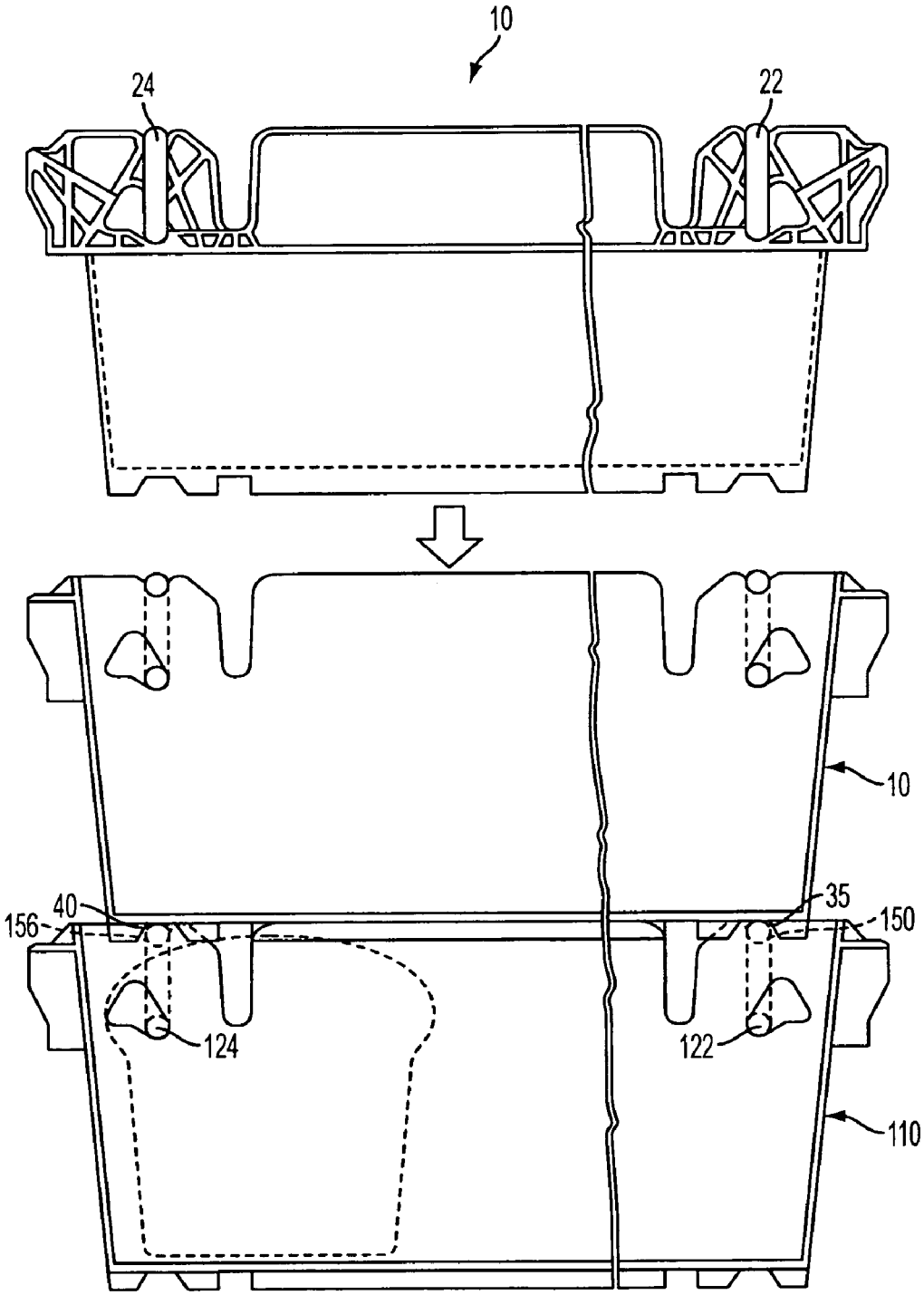
FIG. 5 is a partial side view of the container of FIG. 1 showing the support bar in the first stacking position and a partial sectional side view of the container in a first stacked position with a like container.

Referring to FIG. 5, the container 10 is shown in the first stacked position with the second container 110. The containers 10, 110 are arranged in this position by first placing the support bar 122 in the first outer recess 150 of each sidewalls 114, 116. Similarly, the support bar 124 is placed in the second outer recess 156 of each sidewall 114, 116. The container 10 is then placed on the second container 110 such that the support bar 122 of the second container 110 is received in each first outer recess 35 of the sidewalls 14, 16 of the first container 10. Similarly, the support bar 124 of the second container 110 is received in each second outer recess 40 of the sidewalls 14, 16 of the first container 10. Clearly, the first container 10 rests on the support bars 122, 124 of the second container 110.

Figure 6:
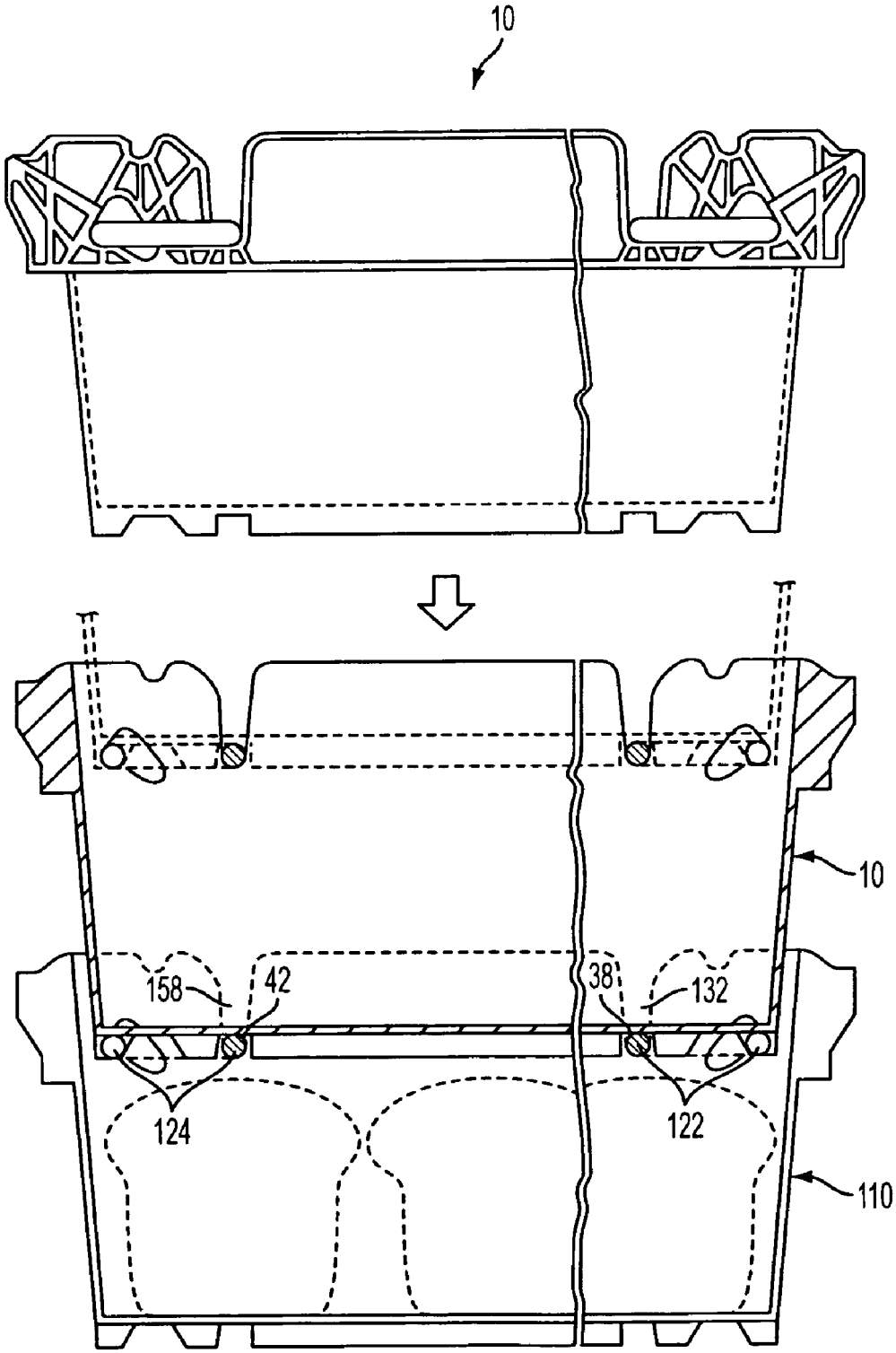
FIG. 6 is a partial side view of the container of FIG. 1 showing the support bar in the second stacking position and a partial sectional side view of the container in a second stacked position with a like container.

Referring to FIG. 6, the container 10 is shown in the second stacked position with the second container 110. The containers 10, 110 are arranged in this position by first placing the support bar 122 in the first inner recess 152 of each sidewall 114, 116. Similarly, the support bar 124 is placed in the second inner recess 158 of each sidewall 114, 116. The container 10 is then placed on the second container 110 such that the support bar 122 of the second container 110 is received in each first inner recess 38 of the sidewalls 14, 16 of the first container. Similarly, the support bar 124 of the second container 110 is received in each second inner recess 42 of the sidewalls 14, 16 of the first container 10. Again, in this position, the first container 10 rests on the support bars 122, 124 of the second container 110.

Referring to FIGS. 4 to 6, it will be apparent that each of the stacking positions provides a different base 12 to base 112 spacing between the container 10 and the second container 110. This spacing is greatest when the containers 10, 110 are in the first stacked position, intermediate when the containers 10, 110 are in the second stacked position, and least when the containers 10, 110 are in the nested position. The nested position is generally used when the containers 10, 110 are empty. The first or second stacking positions are generally chosen depending on the size or quantity of goods in the containers 10, 110.

While the embodiment discussed herein is directed to a particular implementation of the invention, it will be apparent that variations of this embodiment are within the scope of this invention. For example, the size and shape of any of the features described can vary while still performing the same functions. The sidewalls, for instance, can differ in length or all sidewalls can be equal in length. In the above-described embodiment, the base and sidewalls of the container are injection-molded high-density polyethylene and the support bars are stainless steel, but other materials and forming processes can be used. Also, the sidewalls can include a handle or an aperture for handling the container.

What is claimed is:

1. A container comprising:

a base configured to provide vertical support to objects;

a pair of side walls;

a pair of opposing walls projecting above the base, each of the opposing walls presenting an exterior surface defining two downwardly-curved receptacles, each of the opposing walls including:

an upper edge; and at least two grooves and four notches provided in the upper edge, an inner two of said notches extending deeper into the opposing wall, when measured perpendicular to the upper edge adjacent the corresponding notch, than an outer two of said notches, said each opposing wall extending vertically upward in between the inner two of said notches to a height above a bottommost surface of any notch;

two support members, each support member being pivotally mounted within receptacles of opposing walls to facilitate pivotal movement of said each support member relative to the opposing walls;

wherein each support member is configured to rest within pairs of grooves and notches of the opposing walls for effecting retention of said each support member at three different support member rest positions, one of said support member rest positions being lower than the other support member rest positions.

2. The container as claimed in claim 1, wherein the inner two notches of each opposing wall are configured to receive the support members to facilitate support of a second identical container at a first stacking height above the base, and wherein the outer two notches of each opposing wall are configured to receive the support members to facilitate support of the second identical container at a second stacking height above the base, wherein the first stacking height is different than the second stacking height.

3. The container as claimed in claim 2, wherein the inner two notches of each opposing wall are configured to receive and retain the support members at a first support member height above the base, and wherein the outer two notches of each opposing wall are configured to receive and retain the support members at a second support member height above the base, wherein the first support member height is lower than the second support member height.

4. The container as claimed in claim 3, wherein the inner two notches of each opposing wall have a first notch depth, and wherein the outer two notches of each opposing wall have a second notch depth, wherein the first notch depth is different than the second notch depth.

5. The container as claimed in claim 4, wherein the exterior surface of each of the opposing walls defines two receptacles for effecting pivotal mounting of the support members to the exterior surface of each of the opposing walls.

6. The container as claimed in claim 5, wherein each said support member comprises a single-piece, substantially C-shaped bar having two inwardly-turned ends, and wherein each of the inwardly-turned ends is disposed in a corresponding one of the receptacles provided in the exterior surface of each of the opposing walls, the inwardly-turned ends being moveable within the receptacles.

7. The container as claimed in claim 6, wherein each of the receptacles receives a respective one of the inwardly-turned ends to facilitate pivotal movement of the corresponding support member about a pivot axis which is moveable relative to the container.

8. A container comprising:

a base configured to provide vertical support to objects;

a pair of end walls, each having a groove along an upper portion thereof;

a first retainer means;

a second retainer means being spaced apart and opposing the first retainer means;

wherein each of the first and second retainer means projects above the base and has an exterior surface, and wherein each of the first and second retainer means includes:

a first sidewall portion defining an outer pair of notches and an inner pair of notches, the inner pair of notches extending deeper into the first sidewall portion, when measured perpendicular to a top of the first sidewall portion on opposite sides of the corresponding notch, than the outer pair of notches;

a second sidewall portion disposed between the inner pair of notches and extending upward between the inner pair of notches to a height above the bottom-most surface of any notch;

a pair of openings disposed in the exterior surfaces of each of the first sidewall portions, each opening having a concave-shaped upper portion and a convex-shaped lower portion, the convex-shaped lower portion having a middle section which extends vertically above adjacent left and right side sections; and pivotally mounted in the openings disposed in the respective first sidewall portions to facilitate pivotal movement of the support members relative to each of the respective first sidewall portions, wherein each support member is configured to register within respective grooves and pairs of notches for effecting retention of the support member at three different support member rest positions.

9. The container as claimed in claim 8, wherein each of the first and second sidewall portions is configured to oppose the objects vertically supported by the base.

10. The container as claimed in claim 9, wherein each of the first and second sidewall portions is configured to provide lateral support to the objects vertically supported by the base.

11. The container as claimed in claim 10, wherein the inner pair of notches is configured to receive and retain the support members to facilitate support of a second identical container at a first stacking height above the base, and wherein the outer pair of notches is configured to receive and retain the support members to facilitate support of the second identical container at a second stacking height above the base, wherein the first stacking height is different than the second stacking height.

12. The container as claimed in claim 11, wherein the inner pair of notches is configured to receive and retain the support members at a first support member height above the base, and wherein the outer pair of notches is configured to receive and retain the support members at a second support member height above the base, wherein the first support member height is different than the second support member height.

* * * * *